United States Patent [19]

Simpson

[11] 3,991,698

[45] Nov. 16, 1976

[54] BOAT LIFT

[76] Inventor: Curtis W. Simpson, 632 SW. 34, Oklahoma City, Okla. 73109

[22] Filed: Aug. 14, 1975

[21] Appl. No.: 605,110

[52] U.S. Cl. ..... 114/66.5 R
[51] Int. Cl.[2] ..... B63B 1/16
[58] Field of Search ..... 114/56, 66.5 R, 66.5 P, 114/66.5 S; 9/310 R

[56] References Cited

UNITED STATES PATENTS

| | | | |
|---|---|---|---|
| 1,805,131 | 5/1931 | Donaldson | 114/66.5 P |
| 3,186,370 | 6/1965 | Hoyle | 114/66.5 R |
| 3,226,739 | 1/1966 | Noe | 114/56 X |
| 3,227,122 | 1/1966 | Noe | 114/66.5 R |

*Primary Examiner*—Trygve M. Blix
*Assistant Examiner*—Gregory W. O'Connor
*Attorney, Agent, or Firm*—Robert K. Rhea

[57] ABSTRACT

A pair of elongated ski-like members are secured in parallel spaced-apart relation to the rearward end portion of the bottom surface of a boat hull for supporting the bottom surface adjacent the surface of the water during a predetermined rate of acceleration.

1 Claim, 5 Drawing Figures

BOAT LIFT

BACKGROUND OF THE INVENTION

1. Field of the Invention

The present invention relates to boats and more particularly to boat lifts for increasing the planing efficiency of boats.

2. Description of the Prior Art

Hydrofoil devices as used on boats or hydroskis as applied to seaplanes have usually comprised a hydrofoil attached to the boat bottom or seaplane fuselage by depending strut members, some of which are foldable toward and away from the supporting body. This type of hydrofoil has the disadvantage, when applied to boats on inland waters, of collecting moss or other floating material which tends to defeat the boat lifting action of the hydrofoil.

This invention overcomes this objection by forming elongated ski-like members which are directly connected to the boat bottom and provided with a converging forward end portion which reduces drag and offers no projection engaging floating objects encountered.

SUMMARY OF THE INVENTION

A pair of elongated runners or ski-like members are attached to the depending surface of a boat bottom in parallel spaced relation on respective opposing sides of the longitudinal centerline of the boat. The vertical thickness or distance between the top surface and depending limit of the respective runner is such that they lift the depending surface of the boat bottom substantially out of the water when the boat is being accelerated forwardly.

The principal objects of this invention are to provide lifts for boats, or the like, to elevate the boat from the surface of the water for either sport or utility, to provide a high degree of stability without hindering maneuverability, which is operative at relatively slow speeds for use on boats of low power, as well as those having high power, and which offers a minimum of resistance to the water and floating objects.

DESCRIPTION OF THE PREFERRED EMBODIMENTS

Figure 1:
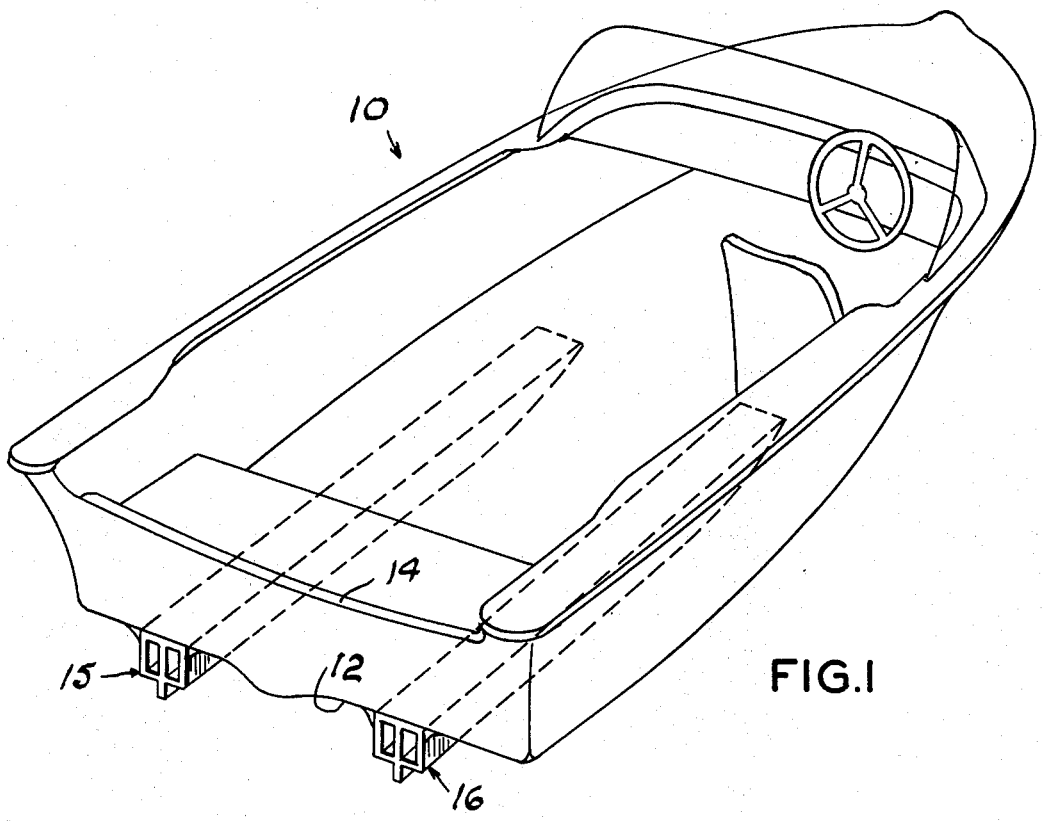
FIG. 1 is a perspective view of a boat illustrating the relative position of the boat lifts by solid and dotted lines.
Figure 2:
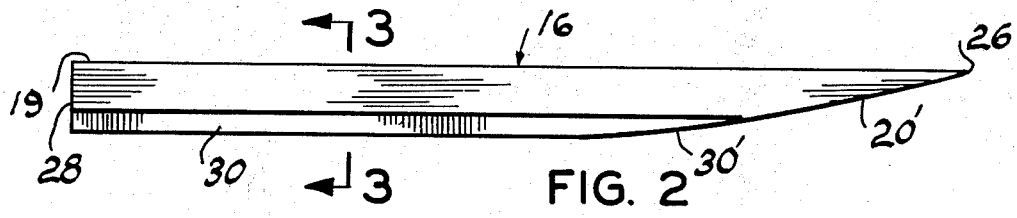
FIG. 2 is a side elevational view of one of the boat lifts.
Figure 3:
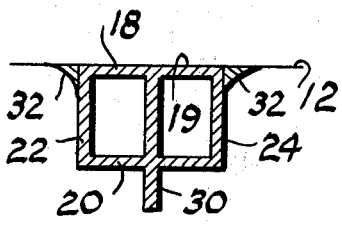
FIG. 3 is a vertical cross sectional view taken substantially along the line 3—3 of FIG. 2; and, FIGS. 4 and 5 are similar vertical cross sectional views of alternative embodiments.

Like characters of reference designate like parts in those figures of the drawings in which they occur.

In the drawings:

The reference numeral 10 indicates a small boat, such as is used for pleasure or utility on inland waters, having a flat or warped bottom 12 and a transom 14. The numerals 15 and 16 indicate a pair of ski-like runners which are identical in configuration and in the interest of brevity, only the runner 16 will be described in detail. The runner 16 is elongated, substantially rectangular in general configuration, preferably formed of light-weight material offering a low coefficent of friction when moved relative to the water. The runner material may be fiberglass or a combination of fiberglass over sheet material. The runner 16 is provided with a top panel 18 having a transversely flat upper surface 19. The top panel is connected with a parallel transversely flat bottom panel 20 by vertical side members 22 and 24 thus describing a box-channel configuration in transverse section. The forward end portion of the box-channel shape is closed by the bottom panel being inclined for converging with the top panel 18, as at 20', at the forward end 26 of the runner thus forming a ski-like configuration for the runner, the runner being open at its rearward end 28 in the plane of the transom 14.

A longitudinal vertical fin 30 transversely divides the box-channel shape and projects in depending relation below the bottom panel 20 a selected distance. The forward depending end portion of the fin is similarly inclined forwardly and upwardly, as at 30', in cooperation with the inclined surface 20'.

The runners 15 and 16 are disposed on the depending surface of the boat bottom 12 in parallel spaced-apart relation spaced equidistant laterally of the longitudinal boat centerline or chine if present. The runners are secured to the boat bottom surface by any suitable means, such as by screws or bolts, not shown, or fiberglass bonding material for forming gussets 32 at the respective juncture of the side walls 22 and 24 with the under surface of the boat bottom 12.

The overall size of the runner is determined by the size and mass of the boat to which it will be attached. I have found that runners having an overall length of approximately 6 feet, a transverse width of approximately 10 inches and a vertical dimension of approximately 8 inches are satisfactory when used on a boat fourteen feet in length operating as a pleasure boat on lakes, or the like. The fin 30 preferably projects below the bottom panel 20 of the runners approximately 3 inches and is for the purpose of stabilizing the boat by preventing or dampening lateral movement of the boat when executing a turn.

Figure 4:
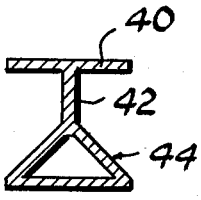

Referring to FIG. 4, an alternative embodiment of the boat lift runner is shown which comprises an elongated top panel 40 having a central depending fin 42 secured to the apex of a triangular-shape, in cross section, bottom member 44.

Figure 5:
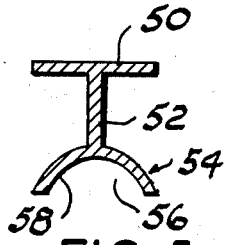

FIG. 5 illustrates a further cross sectional configuration of boat lift runners comprising a similar top panel 50 to be secured to the boat bottom 12 having a centrally connected depending fin 52 secured to a part-circular elongated member 54 forming a downwardly transversely concave recess 56 and defining a longitudinal arcuate planing surface 58.

OPERATION

In operation, the runners 15 and 16 are connected with the boat bottom 12 as described hereinabove wherein the boat may move slowly or in shallow water with the runners submerged and offer a minimum of resistance to moss or aquatic growth. When the boat is accelerated forwardly by its power plant, not shown, the runners function in a ski-like manner to lift the boat bottom substantially out of contact with the surface of the body of water being traversed thus providing a planing action with a relatively small area in contact with the water.

Obviously the invention is susceptible to changes or alterations without defeating its practicability. Therefore, I do not wish to be confined to the preferred embodiments shown in the drawings and described herein.

I claim:

1. A boat lifting device, comprising:

a pair of elongated hollow members each having a planar top panel characterized by an upper surface adapted to longitudinally contiguously contact and be secured to the bottom surface of a boat hull, said members each having a forward end portion and having a coextensive bottom panel of equal width with its bottom surface spaced below said upper surface throughout the major portion of its length a distance substantially equal to eight-tenths its transverse width and converging toward said upper surface at its forward end portion;

side panels extending between and interconnecting said top and bottom panels for forming a box-shape in transverse section; and, a substantially coextensive vertical stabilizing fin bisecting each said member and depending beyond the bottom surface of each said bottom panel a distance at least equal to three-tenths the transverse width of said members.

* * * * *